United States Patent [19]

Pask

[11] 3,986,789

[45] Oct. 19, 1976

[54] STATOR STRUCTURE FOR A GAS TURBINE ENGINE

[75] Inventor: George Pask, Stanton-by-Bridge, England

[73] Assignee: Rolls-Royce (1971) Limited, London, England

[22] Filed: Aug. 18, 1975

[21] Appl. No.: 605,295

[30] Foreign Application Priority Data

Sept. 13, 1974 United Kingdom ..... 39958/74

[52] U.S. Cl. ..... 415/178; 415/217

[51] Int. Cl.[2] ..... F01D 5/08

[58] Field of Search ..... 415/217, 218, 173 B, 415/116, 178

[56] References Cited

UNITED STATES PATENTS

| | | | |
|---|---|---|---|
| 2,997,275 | 8/1961 | Bean et al. | 415/218 |
| 3,004,700 | 10/1961 | Warren | 415/218 |
| 3,393,894 | 7/1968 | Redsell | 415/217 |
| 3,519,366 | 7/1970 | Campbell | 415/217 |
| 3,542,483 | 11/1970 | Gagliardi | 415/217 |
| 3,628,880 | 12/1971 | Smuland | 415/216 |
| 3,728,041 | 4/1973 | Bertelson | 415/218 |
| 3,752,598 | 8/1973 | Bowers et al. | 415/173 B |
| 3,938,906 | 2/1976 | Michel et al. | 415/217 |
| 3,947,145 | 3/1976 | Michel et al. | 415/217 |

*Primary Examiner*—Henry F. Raduazo
*Attorney, Agent, or Firm*—Cushman, Darby & Cushman

[57] ABSTRACT

A stator structure for a gas turbine engine comprises abutting segments sealed together at their abutting edges. Each segment comprises a plate spaced from a peripheral surface to form a groove in the edge, and the grooves in abutting edges correspond to form a channel in which a sealing member is positioned.

9 Claims, 3 Drawing Figures

STATOR STRUCTURE FOR A GAS TURBINE ENGINE

This invention relates to a stator structure for a gas turbine engine.

Stator structures for gas turbine engines often comprise a plurality of separate portions held together to form the complete stator structure. Thus a typical stator structure may comprise a plurality of part annular segments, each including one or more aerofoil vanes, which abut together to form a complete annulus. In order to reduce or prevent leakages between the segments some form of sealing is required, and one successful form of sealing is as described in British Pat. No. 1,081,458. In this structure at least some of the abutting faces of the segments are provided with corresponding grooves, into which are assembled strips of material which extend into the opposed grooves in both the abutting faces and form a seal. This construction may not be entirely satisfactory where the temperature of the stator is such as to require cooling of the stator parts adjacent the seal, since to allow room for the grooves the metal of the stator part is normally thickened locally and consequently a relatively thick edge is formed. This edge may be difficult to cool, particlarly when the cooling is carried out from the surface away from the hot gas flow by means of gas flow through an impingement plate.

The present invention provides a structure which may enable the thickness of the grooved edge to be reduced and which may simplify the attachment of impingement cooling plates to the stator.

According to the present invention a stator structure for a gas turbine engine comprises at least two stator segments sealed together at abutting edges, each abutting edge having a groove therein formed between a peripheral surface of the segment and an edge portion of a plate spaced from said surface, the grooves on the abutting edges corresponding to form a channel, and a common sealing member positioned within each said channel and extending into the grooves in the abutting edges to seal between the segments.

Said plate preferably comprises the continuation of an apertured impingement plate adapted to cause cooling air to impinge on that surface of the shroud which does not contact the gas stream of the engine.

Said plate may be spaced from said peripheral surface by a rib, or a pedestal or other projection.

Said stator structure may comprise an aerofoil vane having inner and outer shrouds, and said edge may comprise an edge of one shroud of the stator.

Said plate may be bonded to the stator, said bonding preferably comprising metallurgical bonding such as brazing or welding.

Figure 1:
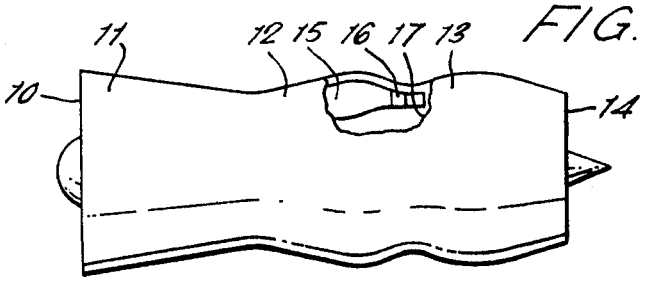
Figure 2:
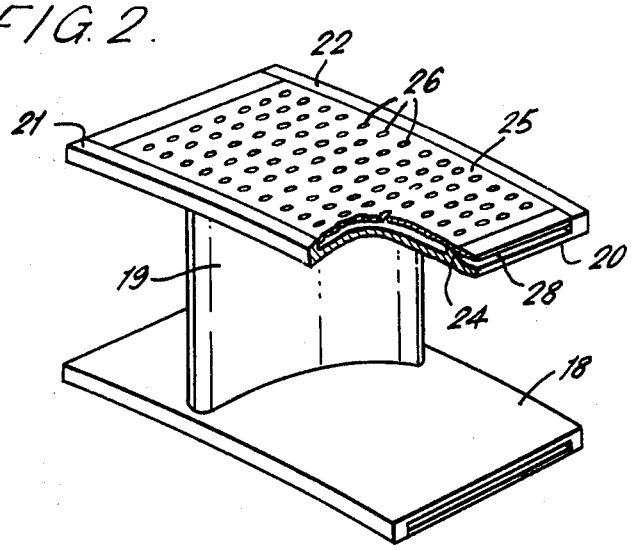
Figure 3:
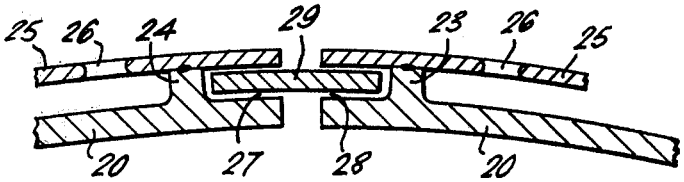

The invention will now be particularly described, merely by way of example, with reference to the accompanying drawings in which:

FIG. 1 is a partly broken-away view of a gas turbine engine having stator structure in accordance with the invention, FIG. 2 is a perspective view of a stator vane of the engine of FIG. 1, and FIG. 3 is an enlarged section of the abutting edges of the outer shrouds of two of the stators of FIGS. 1 and 2.

In FIG. 1 there is shown a gas turbine comprising an air intake 10, a compressor 11, a combustion system

12, a turbine 13 and a final nozzle 14. The casing of the engine is shown broken way in the region of the combustion system to expose to view the combustion chamber 15, the nozzle guide vanes 16 and the turbine rotor 17.

As is known in the art, the nozzle guide vanes 16 serve to direct hot gases from the combustion chamber 15 on to the turbine blades; consequently the vanes are subject to high temperatures and provided with a cooling system described below. In the present embodiment, the vanes 16 each comprise an inner shroud 18, an aerofoil portion 19 and an outer shroud portion 20. The separate vanes 16 are assembled together in the engine to form a complete annulus, the edges of the shrouds 18 and 20 abutting against corresponding edges of the shrouds of adjacent vanes to form substantially completely annular shrouds. To reduce gas leakage between abutting shrouds a seal is necessary, and this is provided in the manner described below with reference to FIGS. 2 and 3.

Both of the shrouds 18 and 20 are provided with similar sealing and cooling arrangements, and for convenience only those of the outer shroud 20 are shown and described in detail. The shroud 20 is provided on its surface remote from the hot gas flow with forward and rearward raised lips 21 and 22 at its front and rear edges and raised seal ribs 23 and 24 which extend parallel with the side edges of the shroud 20 but are spaced from the edges by a constant small distance to leave a narrow peripheral surface. Apart from these lips and ribs are shroud surface in question is curved to form part of the shroud annulus.

An impingement plate 25 is brazed to the lips 21 and 22 and the ribs 23 and 24. The plate abuts against the lips 21 and 22 and is brazed at its edge to these lips, while it extends over the top of the ribs 23 and 24 and its undersurface is brazed to the top of the ribs. The plate extends beyond the ribs 23 and 24 to terminate, in this embodiment, in the plane of the edge of the shroud itself. It should however be noted that the plate need not terminate exactly in this plane.

The plate 25 is shaped to match the shape of the shroud surface which it overlays, and it is therefore spaced from this surface by a small constant distance equal to the height of the ribs 23 and 24. The major portion of the plate, which lies between the ribs 23 and 24, is provided with a plurality of small impingement holes 26 therethrough. Cooling air from a source not shown but which may conveniently be from a bleed from the compressor, is fed to the upper surface of the plate 25 and flows through the holes 26 in the plate 25 in the form of a plurality of jets which impinge on, and thus cool, the upper surface of the shroud 20. The cooling air then flows away through passages not shown; it may be exhausted through holes in the lip 22 into the main gas flow, or it may pass into the hollow interior of the aerofoil section 19 to provide cooling.

The portions of the plate 25 which extend beyond the ribs 23 and 24 are unapertured in this embodiment, although it would be possible to extend the impingement cooling to this area as in the modification described below, and it will be seen that in conjunction with the peripheral surface of the shroud which extends past the ribs, grooves 27 and 28 are formed which extend from the forward lip 21 to the rearward lip 22, i.e. substantially over the whole length of the edge of the shroud.

As can be seen in FIG. 3, when two vanes are assembled together, the groove 27 on one vane corresponds with the groove 28 on the abutting shroud portion, and in the rectangular section channel thus formed, a sealing strip 29 is retained. Any gas leakage between the shroud portions will press the strip 29 against the upper surface of the edge portions 20, thus providing a good seal. It may also be desirable to deform the edges of the plates 25 to nip them down into contact with the strip 29 to provide improved sealing due to the taking up of manufacturing tolerances.

The device described provides a number of advantages over the prior art construction, in which complete grooves are cast or machined in a thickened edge part of the shrouds or other abutting edges. Since the sheet metal of which the plate 25 is made is of very accurately controlled thickness, the total thickness of the edge portion may be made less without any danger of the groove breaking out of the shroud surface. Since the rebates may be machined from above, it will be possible to effect machining of the complete top surface of one or more shrouds in the same operation. Again, the tops of the ribs 23 and 24 may be very accurately machined to provide a very narrow groove, and consequently an even thinner edge; a very thin flexible metal strip 29 may then be used with consequent ease of assembly when the abutting edges and grooves are curved or shaped in some manner; this may then be gripped by nipping down the plates 25. It would be possible to replace the strip 29 in other instances by alternative sealing members.

It will be understood that as described above the inner shroud 18 is provided with a similar construction to that of the shroud 20. However, the construction of the invention is applicable to one shroud only, or to part of one shroud or to abutting portions other than shrouds. And it will be noted that although the most benefit is obtained by utilising the impingement cooling plate as one member forming the grooves 27 and 28, it would be possible to use a separate strip or plate of metal, particularly in the case where there is no impingement cooling.

Again, in the embodiment described the plate 25 is brazed to the shroud; clearly other metallurgical, or in some cases adhesive, bonds could be used.

It will also be noted that while the ribs 23 and 24 provide a useful means of spacing the plate 25 from the shroud surface, it would be possible to form a rebate or cut-away portion in the edge of the shroud and overlay the peripheral surface thus produced with the plate to form the necessary groove, thus not using the ribs.

Again, where the plate 25 is already spaced from the shroud upper surface by projections such as pedestals or pin fins these may be used instead of the ribs 23 and 24; this may depend on the nip of the plate 25 providing efficient sealing with the strip.

As mentioned above, impingement cooling may be extended beyond the ribs 23 and 24 by providing the necessary apertures in the plate 25, provided that the groove is evacuated to a suitable low pressure area such as that existing downstream of the rib 22.

I claim:

1. A stator structure for a gas turbine engine comprising at least two stator segments having abutting edges at which they are sealed together, each stator segment including at least a shroud having a hot gas contacting surface and an opposed peripheral surface, spacing means, and a plate spaced from said opposed peripheral surface by said spacing means to define a groove in each of the edges of said stator segment, said plate having apertures therethrough arranged to direct cooling fluid onto said opposed peripheral surface in the form of a plurality of jets to provide impingement cooling thereof, and a common sealing member positioned within each of said channels and extending into the opposed grooves in the abutting edges of said stator segments to seal between said stator segments.

2. A stator structure as claimed in claim 1 and in which said spacing means comprises at least one rib.

3. A stator structure as claimed in claim 1 and in which said spacing means comprises a plurality of pedestals.

4. A stator structure as claimed in claim 1 and in which said opposed peripheral surface is formed as a cut-away portion of the edge of the segment, said plate having an edge portion which overlays the cut-away peripheral surface to form said groove.

5. A stator structure as claimed in claim 1 and in which said plate has an edge portion which cooperates with said opposed peripheral surface of said shroud to form said groove, said edge portion being deformed to bring it into contact with said sealing member.

6. A stator structure as claimed in claim 1 and in which each said sealing member comprises a metal strip.

7. A stator structure as claimed in claim 1 and in which said plate has an edge portion which cooperates with an edge portion of said opposed peripheral surface of said shroud to form said groove, said edge portion of said plate being apertured so as to allow cooling fluid to pass therethrough to impingement cool at least part of said edge portion of said shroud.

8. A stator structure as claimed in claim 1 and in which plate is metallurgically bonded to said segment.

9. A stator structure as claimed in claim 1 in which said stator segments include at least one aerofoil vane having inner and outer shrouds, said abutting edges of said stator segments comprising edges of said shrouds.

* * * * *